US005544702A

United States Patent [19]

Nishishita

[11] Patent Number: 5,544,702

[45] Date of Patent: Aug. 13, 1996

[54] LAMINATED HEAT EXCHANGER WITH A SINGLE TANK STRUCTURE

[75] Inventor: Kunihiko Nishishita, Konan, Japan

[73] Assignee: Zexel Corporation, Tokyo, Japan

[21] Appl. No.: 425,438

[22] Filed: Apr. 20, 1995

[30] Foreign Application Priority Data

Apr. 28, 1994 [JP] Japan ..... 6-114178

[51] Int. Cl.[6] ..... F28D 1/03

[52] U.S. Cl. ..... 165/153; 165/176; 165/76; 165/DIG. 447; 165/DIG. 466

[58] Field of Search ..... 165/152, 153, 165/176, 76

[56] References Cited

U.S. PATENT DOCUMENTS

| | | | |
|---|---|---|---|
| 4,723,601 | 2/1988 | Ohara et al. | 165/153 |
| 4,800,954 | 1/1989 | Noguchi et al. | 165/153 |
| 4,974,670 | 12/1990 | Noguchi . | |
| 5,042,577 | 8/1991 | Suzumura . | |
| 5,058,662 | 10/1991 | Nguyen | 165/76 |
| 5,332,032 | 7/1994 | Beddome et al. | 165/153 |

FOREIGN PATENT DOCUMENTS

| | | | |
|---|---|---|---|
| 63-14083 | 1/1988 | Japan | 165/153 |

*Primary Examiner*—Allen J. Flanigan
*Attorney, Agent, or Firm*—Wenderoth, Lind & Ponack

[57] ABSTRACT

A laminated heat exchanger has a single tank structure and is of the type which does not have its fin holding portions in contact, but rather has them facing opposite each other over a specific gap. The structure of this heat exchanger ensures that the fins do not extend out of the gaps between the fin holding portions. The laminated heat exchanger has a single tank structure provided with tube elements constituted with tank portions formed by distending at one longitudinal end, and fin holding portions formed by bending at the other longitudinal end. Tanks are constituted on one side of the core by bonding adjacent tube elements. Each tube element of each adjacent pair of tube elements has a pair of fin holding portions facing opposite a pair of fin holding portions of the other tube element of the adjacent pair of tube elements over a specific gap. The distal ends of each pair of tube elements are non-aligned with one another, and thus, the gaps between opposing fin holding portions are non-aligned.

11 Claims, 6 Drawing Sheets

LAMINATED HEAT EXCHANGER WITH A SINGLE TANK STRUCTURE

BACKGROUND OF THE INVENTION

1. Field of the Invention

The present invention relates to a laminated heat exchanger with a single tank structure used mainly in air conditioning systems in motor vehicles.

2. Description of the Related Arts

Heat exchangers of this type in the prior art include a heat exchanger provided with tube elements which are each constituted with a tank portion formed by distension at one end in the direction of the length and a fin holding portion at the other end in the direction of the length formed by bending in which the tube elements are laminated to constitute tanks on one side of the heat exchanger core. The fin holding portions for holding fins are in contact on the opposite side from the tanks of the heat exchanger core. (Refer to, for instance, Japanese Examined Patent Publication No. H4-34080)

In this prior art, since the heat exchanger is structured to have the fin holding portions in contact on the opposite side from the tanks in the heat exchanger core, when brazing the heat exchanger, the brazing material tends to flow into the contact area and this causes a problem in that there may be insufficient brazing material in the other areas.

Because of this, in typical heat exchangers now, the fin holding portions are not put into contact with each other but instead are made to face each other with a gap of specific dimension between them.

However, with the type of heat exchanger in the prior art described above, in which the fin holding portions in adjacent tube elements are not in contact but are positioned facing opposite each other with a gap of specific dimension between them, a problem arises that, during assembly of the heat exchanger, fins tend to extend out of the gaps between the fin holding portions and to become pinched.

In addition, even when the heat exchanger is assembled without the fins extending out, the fins can still be pushed out due to misalignment of the core.

When fins become extended out of the gaps between the fin holding portions in this manner, difficulty in adding the lining may result and also problems such as lowered performance, running out of brazing material and the like may occur.

SUMMARY OF THE INVENTION

Accordingly, the object of the present invention is to provide a laminated heat exchanger with a single tank structure in which the fin holding portions are not in contact, facing each other with gaps of specific dimension between them and the fins are prevented from extending out of the gaps between the fin holding portions by addressing the problems described earlier.

In order to achieve the object described above, the laminated heat exchanger with a single tank structure according to the present invention is provided with tube elements, each of which is constituted with a tank portion formed by distending one end in the direction of the length and a fin holding portion at the other end in the direction of the length. The tanks are formed on one side of the core by bonding the adjacent tube elements, and the fin holding portions are provided on the side opposite from the tanks. The positions at which the fin holding portions face opposite each other with gaps of specific dimension between them are made to be non-linear (i.e. non-aligned). The laminated heat exchanger with a single tank structure according to the present invention may also be provided with an extended portion at the end of one of the fin holding portions that face opposite each other in order to cover the other fin holding portion. Consequently, according to the present invention, since the positions at which the fin holding portions face opposite each other are made non-aligned, the fins are, at least, constantly connected and held by the fin holding portions. The fins are thereby prevented from extending out of the gaps between the fin holding portions.

Moreover, by providing an extended portion at one end of one of the fin holding portions that face opposite each other to cover the other fin holding portion, the gap between the fin holding portions facing opposite each other is covered from the outside. As a result, the gap into which the fin could otherwise extend is blocked off, thereby preventing them even more effectively from extending out.

BRIEF DESCRIPTION OF THE DRAWINGS

These and other advantages, features and objects of the present invention will be understood by those of ordinary skill in the art referring to the annexed drawings, given purely by way of non-limitative example, in which.

DETAILED DESCRIPTION OF THE PREFERRED EMBODIMENTS

The following is an explanation of the embodiments according to the present invention with reference to the drawings.

Figure 1:
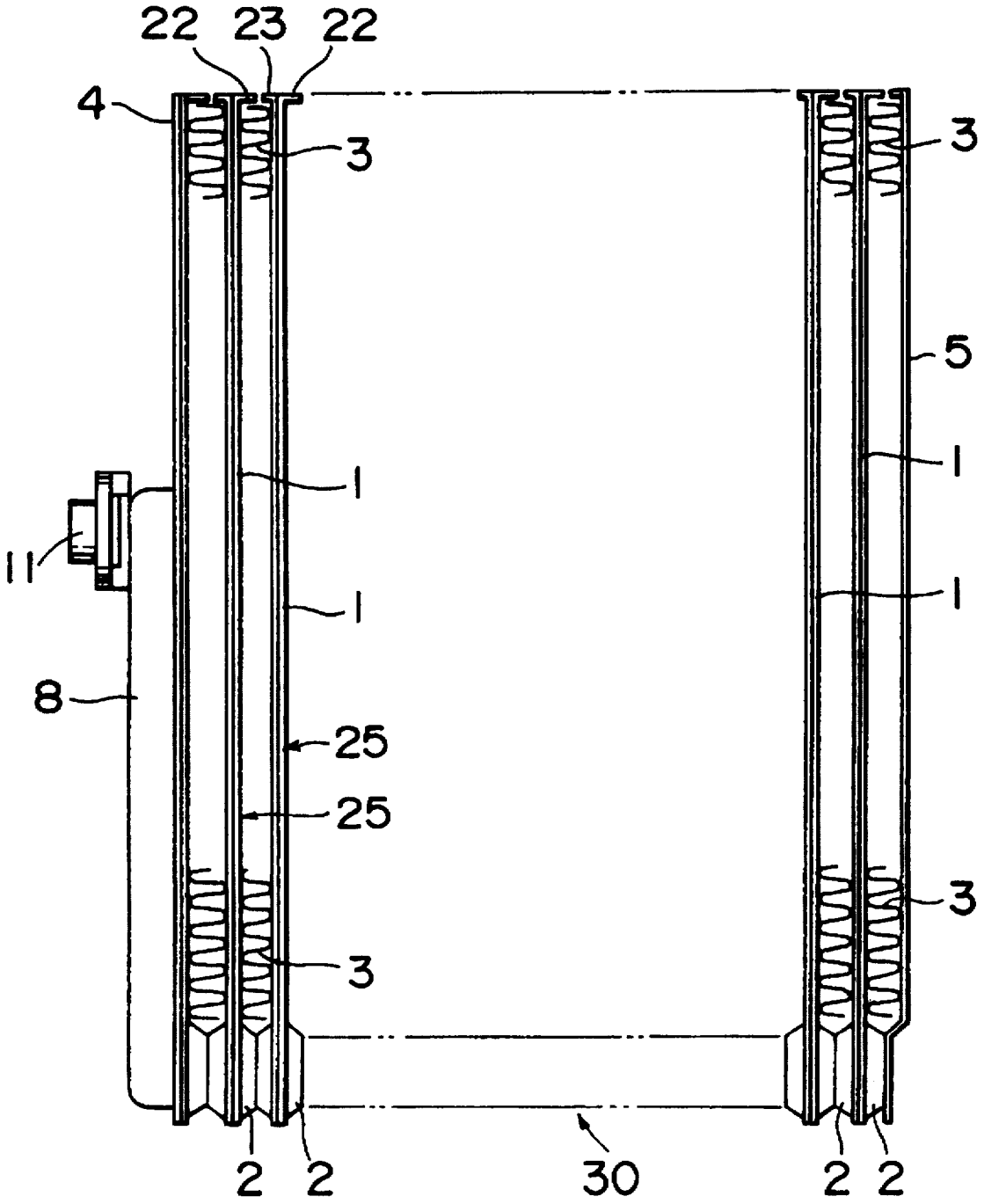
FIG. 1 is a schematic structural diagram of a heat exchanger according to the present invention.
Figure 2:
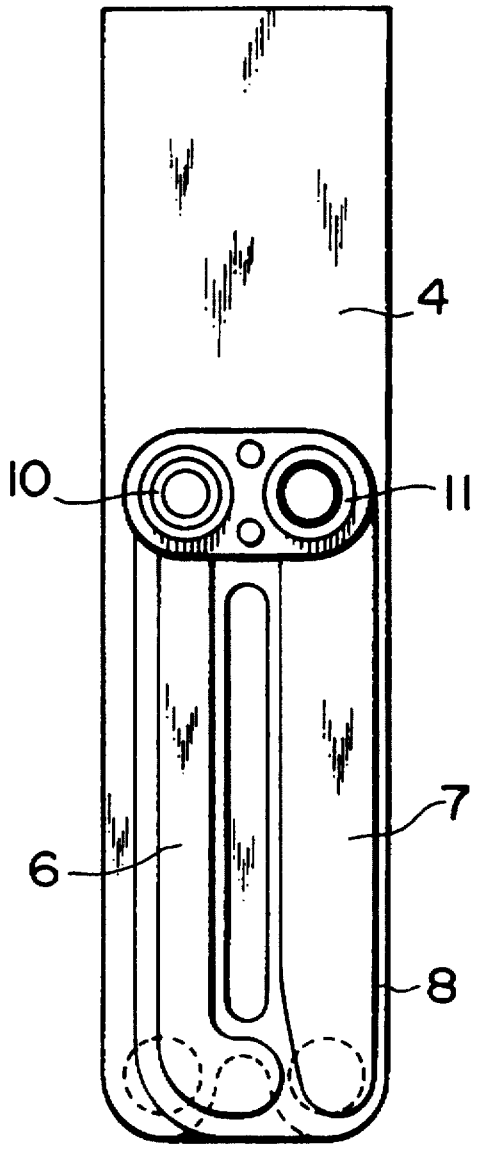
FIG. 2 is a side view of the heat exchanger according to the present invention.

FIGS. 1 and 2 show an example of a heat exchanger according to the present invention. This heat exchanger is provided with corrugated fins 3 laminated alternately with tube elements 1 over a plurality of levels, each of which is provided with a tank portion 2, an end plate 4 at one end, an end plate 5 at the other end in the direction of the lamination, and a passage plate 8 with a supply passage 6 and a discharge passage 7 for the heat exchanging medium which is provided in one of the end plates 4. The supply passage 6 and the discharge passage 7 of the passage plate are attached to an intake pipe 10 and an outlet pipe 11 for heat exchanging medium respectively.

Figure 3:
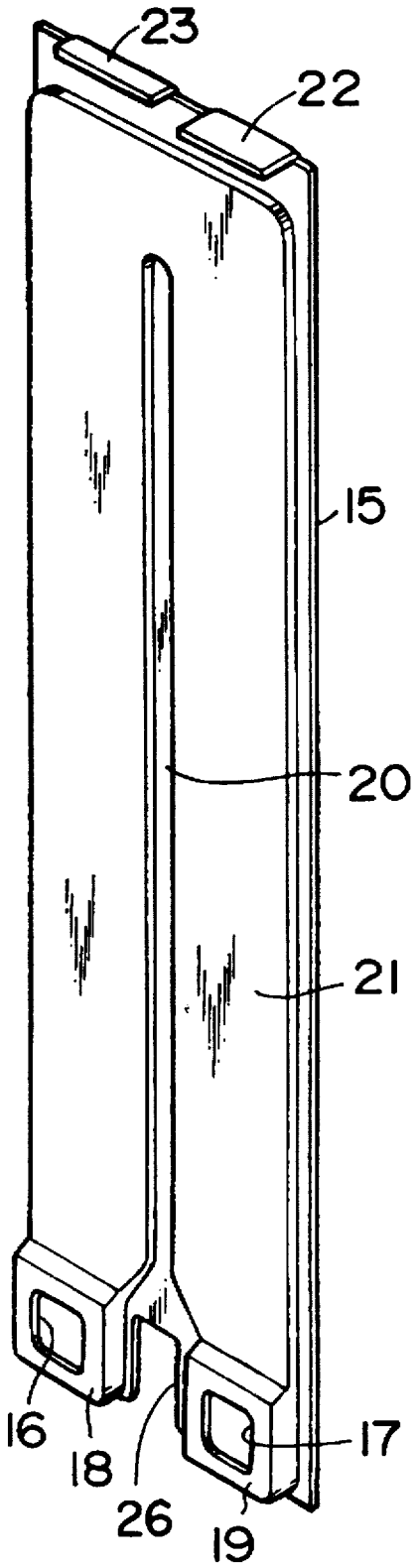
FIG. 3 is a perspective view of a formed plate that constitutes a tube element.

Each tube element 1 is constituted by bonding flush two of the formed plates 15 shown in FIG. 3.

Each formed plate 15 is rectangular in shape and is provided with a pair of indented portions for tank formation 18 and 19 formed by distending at one end of plate 15 in the direction of length, with through holes 16 and 17 respectively, and a projection 20 projecting out from between the indented portions for tank formation 18 toward the other end. It is also provided with an approximately U-shaped indented portion for heat exchanging medium passage formation 21 which is formed by distending and which communicates with the indented portions for tank formation 18 and 19 and is located on the peripheral edge of the projection 20. A notch 26 for passage of a heat exchanging medium supply pipe 38 (to be explained later), is provided between the indented portions for tank formation 18 and 19.

On the other end of this formed plate 15 in the direction of its length, a pair of fin holding portions 22 and 23 for holding the fins 3 are formed by bending toward the outside by individually specific lengths.

A tube element 1 is constituted by bonding two formed plates 15 that are structured as described above, flush to each other. At one end of the tube element a pair of tank portions 2, 2 are constituted by the indented portions for tank formation 18 and 19 which face opposite each other and, at the same time, a heat exchanging medium passage 25 which is roughly U-shaped is constituted on the inside by the indented portions for heat exchanging medium passage formation 21 which face opposite each other. The heat exchanging medium passage 25 communicates with the tank portions 2, 2.

By bonding and laminating the tank portions 2, 2 of such adjacent tube elements 1, 1, a heat exchanger core with a single tank structure is formed, in which a tank 30 is constituted in the lower area and fins 3 are inserted between the tube elements 1 (refer to FIG. 1).

Figure 4:
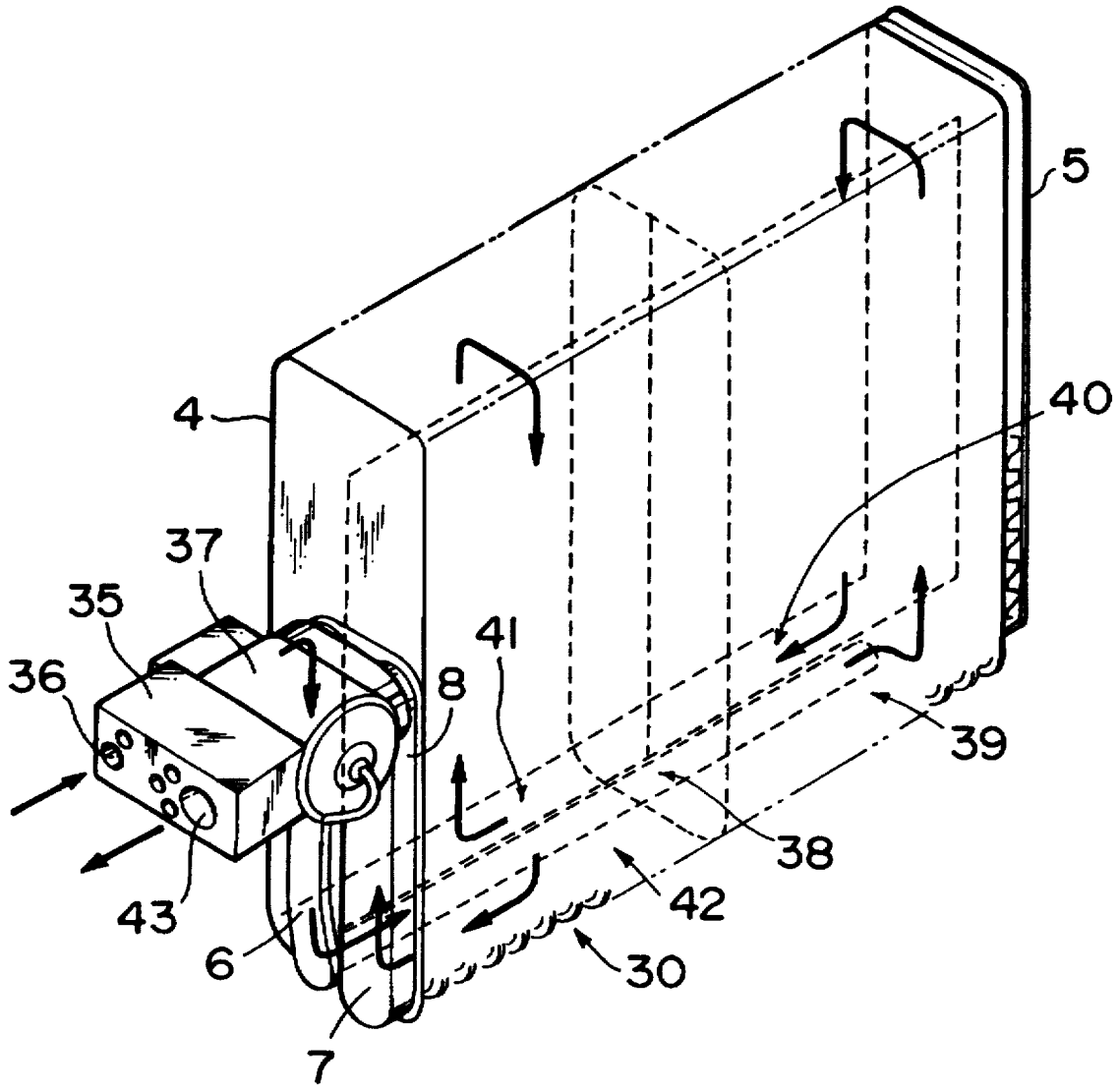
FIG. 4 is a functional diagram illustrating the flow of a heat exchanging medium.

As shown in FIG. 4, the heat exchanger structured as described above has a so-called 4-pass flow pattern, in which heat exchanging medium that is supplied via a heat exchanging medium intake 36 at a joint 35 of a block expansion valve 37, flows to the supply passage 6 of the passage plate 8 via the expansion valve 37, through a heat exchanging medium supply pipe 38 which is connected to the supply passage 6. It then reaches a tank passage 39, which is constituted by the tank portions 2, which communicate at the front on the right side. From the tank passage 39, it flows inside the heat exchanging medium passage 25 of each tube element that communicates with the tank passage 39, to reach a tank passage 40 which is constituted by the tank portions 2 that communicate at the rear on the right side. It then moves horizontally within the tank passage 40 to reach the tank passage 41, which is constituted by tank portions 2 that communicate at the rear on the left side. From the tank passage 41 it flows inside the heat exchanging medium passage 25 of each tube element that communicates with the tank passage 41 to be collected in a tank passage 42, which is constituted by tank portions 2 communicating at the front on the left side. During this process, heat exchanging with the outside air is accomplished. The heat exchanging medium gathered in the tank passage 42 travels through the discharge passage 7 of the passage plate 8 to be discharged through the heat exchanging medium outlet 43 of the joint 35 via the block expansion valve 37.

Figure 5:
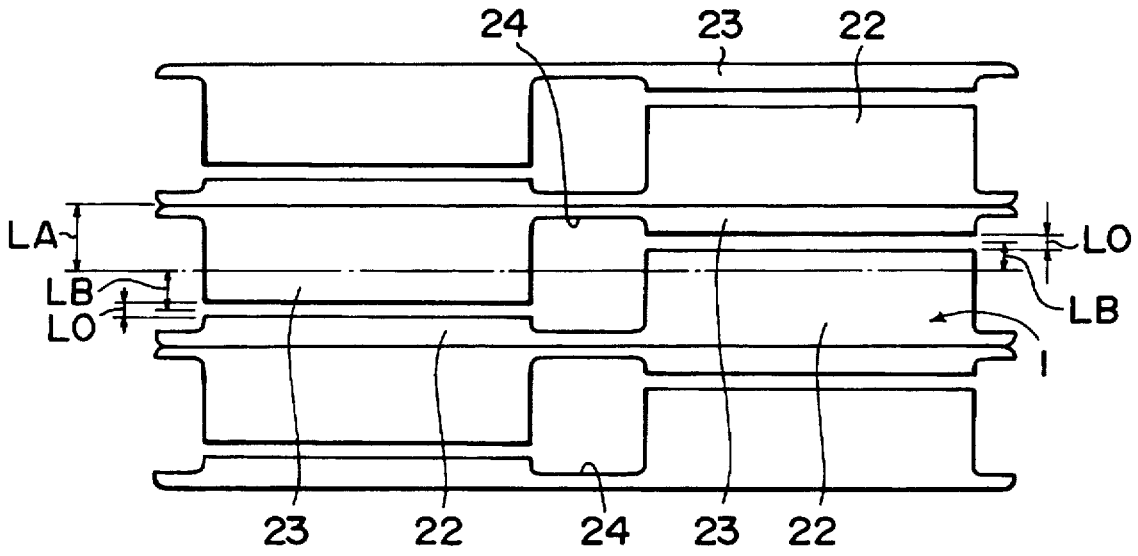
FIGS. 5 and 6 illustrate a structure in which the fin holding portions face opposite each other in the first embodiment of the present invention.
Figure 6:
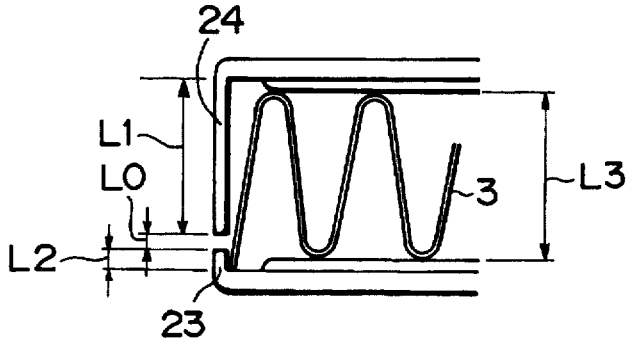

As shown in FIGS. 5 and 6, on the opposite side from the tank 30 in this heat exchanger, the fin holding portions 22 of each tube element 1 face opposite each other over a specific gap distance L0. Note that since the tube elements 1 used here are identical, the fin holding portions 22 and 23 face opposite each other in such a manner that symmetry is achieved from left to right.

The fin holding portion 22 has an oblong shape so that the length of its bend L1 is at least half the height L3 of the fin 3.

The fin holding portion 23 has an oblate shape so that the length of its bend L2 is less than half the height L3 of the fin 3.

In addition, the positions at which the fin holding portions 22, 23 face opposite each other are made to be closer toward one side by a specific distance LB from the central position of the width of the lamination LA between adjacent tube elements 1 across a hole 24 at the center in the direction of the width. In other words, the distal ends of the fin holding portions of each tube element are non-aligned.

The positions at which the fin holding portions face opposite each other is offset by a specific distance from the central position of the width of the lamination between adjacent tube elements 1 across the hole 24 at the center in the direction of the width so that the fins 3 can be prevented from extending out to the outside of the gap between the fin holding portions 22, 23 with the linear fins 3 connected and held by at least one of the fin holding portions 22, 23 of each tube element 1.

When the lengths of the bends of the fin holding portions that face opposite each other are different, and the positions where they face each other (LA+LB) are offset toward the outside from the center (LA), the ends of the linear fins 3 become connected and held by at least one of the fin holding portions 22, 23 and this will prevent the fins 3 from extending out from the gaps.

Note that the positions where the fin holding portions face opposite each other (LA+LB), i.e., the lengths of the bends L1, L2 of the fin holding portions 22, 23, can be selected as appropriate through experiment.

Next, the structure in which the fin holding portions face opposite each other according to the second specified embodiment, is explained with reference to FIGS. 7 and 8.

The structure in which the fin holding portions face opposite each other in the second specified embodiment differs from that in the first specified embodiment described above) in that an extended portion 45 extends at the end of one of the holding portions 22, 23. All the other aspects of the second embodiment are identical to those in the first specified embodiment.

Figure 7:
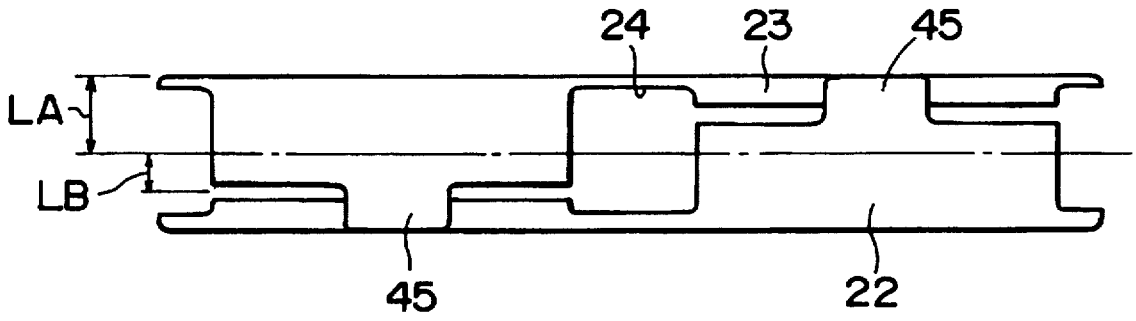
FIGS. 7 and 8 illustrate a structure in which the fin holding portions face opposite each other in a second embodiment of the present invention.
Figure 8:
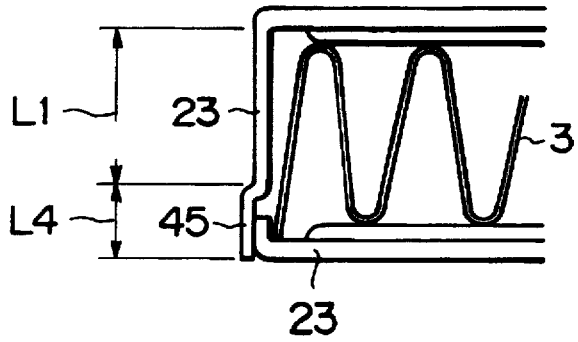

The extended portion 45 extends at the center at the end of the fin holding portion 22, and as shown in FIGS. 7 and 8, it is set in such a manner that it covers the other fin holding portion 23.

By extending the extended portion 45 at the end of one fin holding portion 22, to cover the other fin holding portion 23, the gap between the fin holding portions 22, 23 into which the fin 3 could otherwise extend, is blocked off.

As a result, in addition to the advantages achieved with the heat exchanger according to the first specified embodiment, the fins 3 are even more effectively prevented from extending out. In other words, being covered from the outside, the gap between the fin holding portions 22, 23 is blocked off and the fins 3 do not have any room to extend into.

Note that, while in the embodiment described above, the extended portion 45 extends from the fin holding portion 22 having the longer bend, the extended portion 45 may extend from the fin holding portion 23 having the shorter bend and similar advantages will be achieved.

Figure 9:
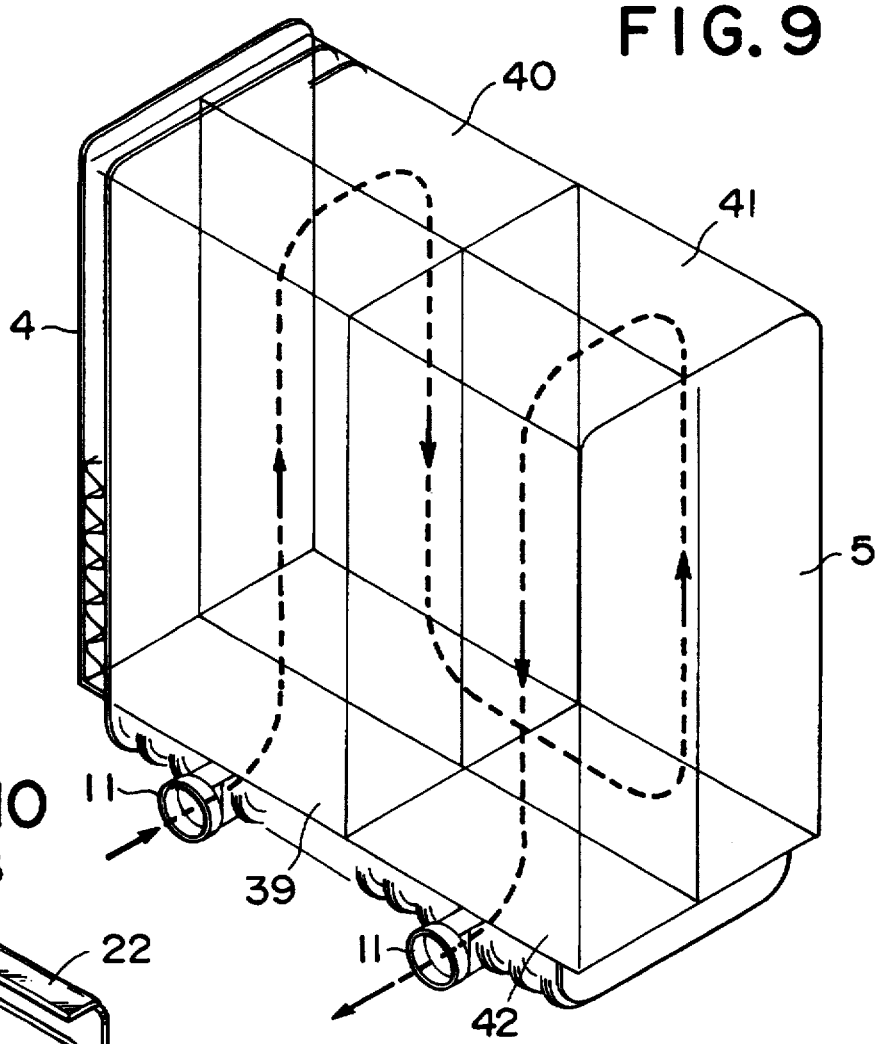
FIG. 9 is a perspective of a laminated heat exchanger in the prior art that employs a structure in which the fin holding portions face opposite each other.
Figure 10:
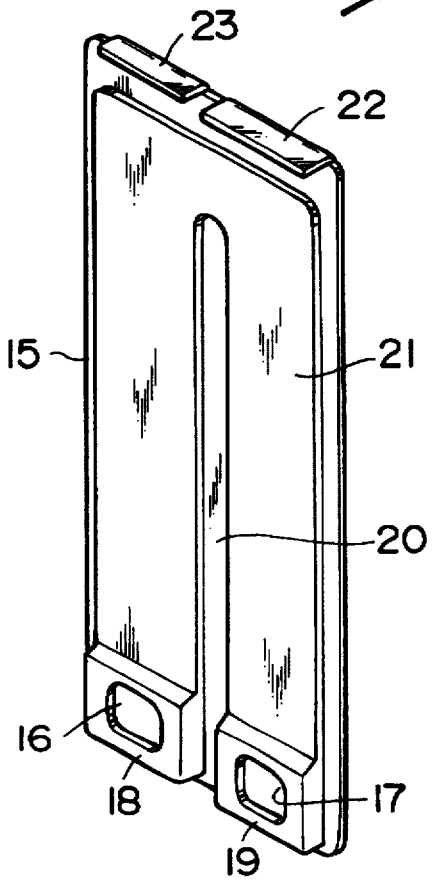
FIG. 10 is a perspective view of a formed plate used in the laminated heat exchanger of FIG. 9.

Also, while the embodiments described so far are constituted by concentrating the intake pipe and the outlet pipe at one of the end plates and attaching the block expansion valve 37, as shown in FIGS. 2 and 4, the present invention may also be applied to currently used heat exchangers, including heat exchangers provided with intake/outlet pipes 11, 11 with openings formed toward the front of the heat exchanger, as shown in FIGS. 9 and 10. This heat exchanger is constituted by laminating tube elements alternatively with fins 3, the tube element formed by butting formed plates 15 flush to each other. Each of the plates 15 is provided with indented portions for tank formation 18 and 19 on one side in the direction of the length, as shown in FIG. 10, a projection 20 extending from between the indented portions for tank formation 18 and 19 and a U-shaped passage 21.

This formed plate 15 is also provided with a pair of fin holding portion 22, 23 for holding the fins which are formed at the other end in the direction of its length by bending toward the outside with specific and different lengths of bends. Because of this, the positions at which the fin holding portions face opposite each other can be set non-linearly (i.e. such that the corresponding fin holding portions are not aligned with one another). Note that the same reference numbers are assigned to like components that are identical to those in the previous in the different embodiments and their explanation is omitted from the description of the later described.

As has been explained, in the laminated heat exchanger with a single tank structure according to the present invention, the distal ends of the fin holding portions face opposite each other are non-aligned with one another to reliably prevent the fins from extending out.

Consequently, defective assembly of the heat exchanger can be prevented.

In addition, in the laminated heat exchanger with a single tank structure provided with the extended portion at one of the pair of fin holding portions that face opposite each other to cover the other fin holding portion, the gap between the fin holding portions that face opposite each other is blocked off. As a result, in addition to the advantages described earlier, the extending out of the fin ends can be even more reliably prevented.

What is claimed is;

1. A laminated heat exchanger comprising:

a plurality of elongate tube elements, each of said tube elements having first and second longitudinal ends and tank portions formed at said first longitudinal end;

a plurality of elongate corrugated fins alternately laminated with said tube elements in a thickness direction substantially perpendicular to the longitudinal direction;

wherein each tube element of each adjacent pair of said tube elements includes a pair of fin holding portions extending in said thickness direction toward the other tube element of said adjacent pair of said tube elements;

wherein said fin holding portions of each said pair of fin holding portions are respectively provided at opposite transverse side portions of said second longitudinal end of the respective said tube element;

wherein distal ends of said fin holding portions of each said pair of fin holding portions are offset relative to one another in said thickness direction; and wherein, for each adjacent pair of said tube elements, said fin holding portions of one of the tube elements which extend toward the other of said tube elements are respectively coplanar with and spaced apart in said thickness direction from said fin holding portions of the other of said tube elements which extend toward said one of said tube elements.

2. A laminated heat exchanger according to claim 1, further comprising end plates mounted at opposing ends of said heat exchanger in said thickness direction; and a passage plate mounted to one of said end plates, said passage plate having a supply passage for supplying heat exchanging medium and a discharge passage for discharging the heat exchanging medium.

3. A laminated heat exchanger according to claim 1, wherein a heat exchanging medium flow path is formed by said tube elements;

said corrugated fins are oriented so as to accommodate air flow therethrough in a first direction; and an intake pipe and an outlet pipe are provided for feeding heat exchanging medium to and accommodating flow of heat exchanging medium away from said heat exchanging medium flow path, said intake pipe and said outlet pipe are mounted adjacent a surface which is perpendicular to said first direction.

4. A laminated heat exchanger according to claim 1, wherein each of said tube elements is constituted by two formed plates bonded together face-to-face;

each of said formed plates includes indented tank formation portions at one longitudinal end thereof, said tank formation portions of said two formed plates of each of said tube elements constituting said tank portions of the respective tube element;

each of said formed plates includes a projection projecting from said indented tank formation portions toward the other longitudinal end of the respective formed plate; and each of said formed plates includes a substantially U-shaped indented passage formation portion communicating with said pair of indented tank formation portions.

5. A laminated heat exchanger according to claim 1, wherein one fin holding portion of each of said pairs of fin holding portions includes an extended portion extending from the distal end of said one fin holding portion and is superposed over the fin holding portion which is opposite said one fin holding portion in said thickness direction.

6. A laminated heat exchanger according to claim 5, wherein for each of said pairs of fin holding portions, said one fin holding portion from which said extended portion extends is the one of said pair of fin holding portions which is longer in said thickness direction.

7. A laminated heat exchanger according to claim 5, wherein for each of said pairs of fin holding portions, said one fin holding portion from which said extended portion extends is the one of said pair of fin holding portions which is shorter in said thickness direction.

8. A laminated heat exchanger according to claim 1, wherein each of said corrugated fins has a predetermined height; and for each of said pairs of fin holding portions, one of said fin holding portions has a length which is greater than one-half said predetermined height, and the other of said fin holding portions has a length which is less than one-half said predetermined height.

9. A laminated heat exchanger according to claim 1, wherein said fin portions of each adjacent pair of said tube elements are positioned with symmetry in a transverse direction, and a hole is formed between said fin portions of each adjacent pair of said tube elements at a center of said tube elements in said transverse direction.

10. A laminated heat exchanger according to claim 9, wherein one fin holding portion of each of said pairs of fin holding portions includes an extended portion extending from the distal end of said one fin holding portion and is superposed over the fin holding portion which is opposite said one fin holding portion in said thickness direction.

11. A laminated heat exchanger according to claim 10, wherein said extended portion extends from a center, in the transverse direction, of said one fin holding portion of each of said pairs of fin holding portions.

* * * * *